United States Patent [19]

Areblom et al.

[11] Patent Number: 4,757,669

[45] Date of Patent: Jul. 19, 1988

[54] VACUUM PACKAGING MACHINERY AND PROCESS

[75] Inventors: Sven P. A. Areblom, Hovaas; Claes-Goeran Rogberg, Lerum, both of Sweden

[73] Assignee: Tex Innovation AB, Kungsbacka, Sweden

[21] Appl. No.: 119,033

[22] Filed: Nov. 10, 1987

Related U.S. Application Data

[63] Continuation of Ser. No. 927,074, Dec. 16, 1986, abandoned, which is a continuation-in-part of Ser. No. 845,896, Mar. 28, 1986, abandoned, which is a continuation-in-part of Ser. No. 331,850, Dec. 17, 1981, abandoned, which is a continuation-in-part of Ser. No. 64,958, Aug. 8, 1979, abandoned, which is a continuation-in-part of Ser. No. 909,930, May 26, 1978, abandoned, which is a continuation-in-part of Ser. No. 735,551, Nov. 1, 1976, abandoned, which is a continuation-in-part of Ser. No. 669,147, Mar. 22, 1976, abandoned.

[51] Int. Cl.[4] ..... B65B 31/02

[52] U.S. Cl. ..... 53/512; 53/526; 53/127; 53/241; 53/256; 53/567

[58] Field of Search ..... 53/127, 241, 256, 427, 53/434, 436, 512, 526, 567; 34/77, 216; 100/211

[56] References Cited

U.S. PATENT DOCUMENTS

| | | | |
|---|---|---|---|
| 2,601,020 | 6/1952 | Hopp | 53/84 |
| 2,847,806 | 8/1958 | Wang | 53/567 |
| 2,932,927 | 4/1960 | Segerstrom | 53/526 |
| 3,257,739 | 6/1966 | Wentz | 34/216 X |
| 3,503,176 | 3/1970 | Crane | 53/256 X |
| 3,511,021 | 5/1970 | Lyon | 53/512 |
| 3,557,526 | 1/1971 | Hartman | 53/567 |
| 3,696,523 | 10/1972 | Beeley | 34/216 |
| 3,958,391 | 5/1976 | Kujubu | 53/434 |
| 3,982,377 | 9/1976 | Vanderpool | 53/256 |
| 4,110,954 | 9/1978 | Ozsson | 53/526 X |

FOREIGN PATENT DOCUMENTS

| | | | |
|---|---|---|---|
| 2519774 | 11/1976 | Fed. Rep. of Germany | 53/434 |
| 291841 | 3/1971 | U.S.S.R. | 53/512 |

*Primary Examiner*—John Sipos

*Attorney, Agent, or Firm*—James W. Hellwege

[57] ABSTRACT

There is provided an overall system of packaging commodities such as garments or other like compressible articles in which the articles are initially conditioned to provide relatively low temperatures and relative humidity, following which the garments are enveloped with wrapping material, and subjected to a vacuum packaging operation. The system may include a transport system for transporting packaged commodities between the wrapping and vacuum packaging steps and stations. The vacuum packaging apparatus in which the apparatus functions to initially compress the central portion of the packaged commodity and progressively outwardly therefrom to provide improved packaging techniques to remove any entrapped air. The wrapping device may vertically envelops a commodity to be packaged. There is also provided a conditioning step and apparatus for conditioning the articles before packaging.

8 Claims, 11 Drawing Sheets

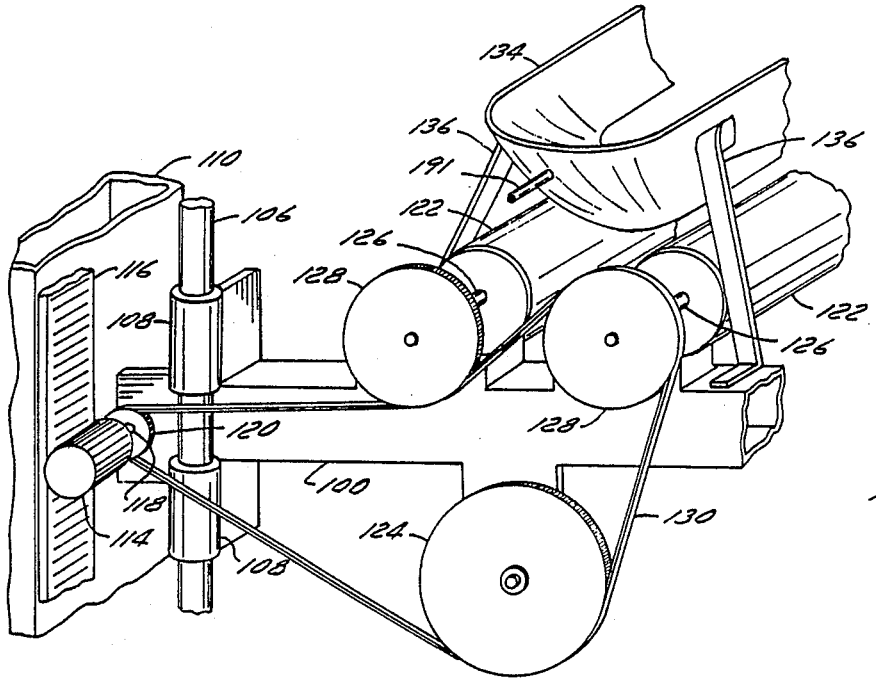
FIG. 10
FIG. 11
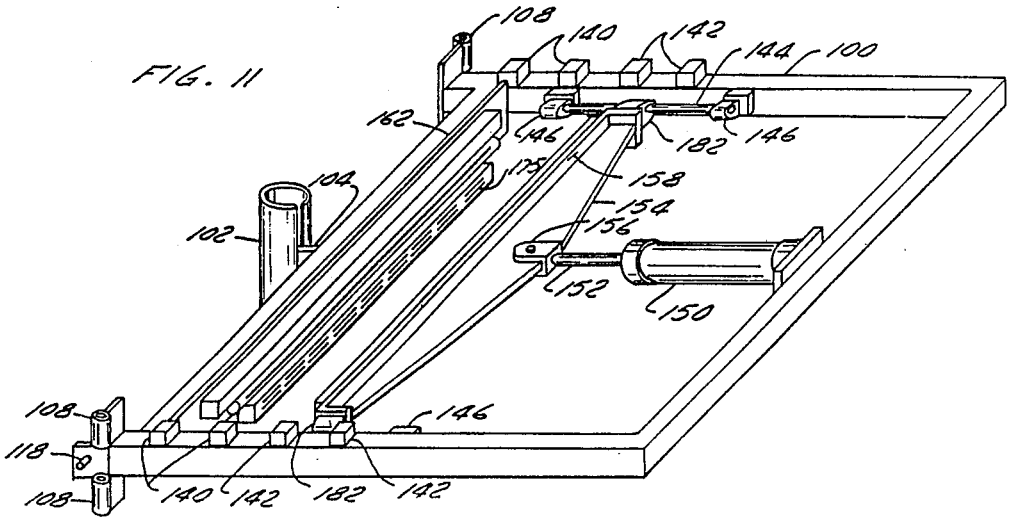

VACUUM PACKAGING MACHINERY AND PROCESS

This application is a continuation application of Ser. No. 927,074, filed Dec. 16, 1986 now abandoned, which is a continuation-in-part of application Ser. No. 845,896, filed Mar. 28, 1986, now abandoned, in turn a continuation-in-part of Ser. No. 331,850, filed Dec. 17, 1981, now abandoned, in turn a continuation-in-part of Ser. No. 064,958, filed Aug. 8, 1979, now abandoned, in turn a continuation-in-part of Ser. No. 909,930, filed May 26, 1978, now abandoned, in turn a continuation-in-part of Ser. No. 735,551, filed Nov. 1, 1976, now abandoned, in turn a continuation-in-part of Ser. No. 669,147, filed Mar. 22, 1976, now abandoned.

In the prior art, it is also shown in Russian Pat. No. 291,841 that a food packaging apparatus can be used to aid in the packaging of meat which is encased in a bag; in this reference, an inflatable tube inserted into a chamber, a vacuum drawn and by drawing the vacuum, the air is exhausted from the bag containing the commodity and the tube expands to fill part of the void in the vacuum chamber to otherwise decrease the amount of time required to create a vacuum in a commodity-containing bag. Tests have shown that by using an inflatable tube in a vacuum chamber, the amount of air that the inflatable tube displaces will be quite minimal and it would appear that highly specialized equipment must be employed in order to create a vacuum of the type required for such a packaging operation. Such tests also have shown that there is no influence in the inflatable tube aiding an expelling air from the bag in which the commodity is vacuum packaged. As illustrated in this reference, since the inflatable tube appears to be only gripped by holding means on the pair of opposed ends, the inflatable tube will not expand equally in all directions.

A further reference in the prior art to a packaging apparatus is shown by Vanderpool U.S. Pat. No. 3,982,277. This reference is directed to providing a protective cover for clothes which have been drycleaned, in which a garment is placed within a length of wrapping material. Vanderpool is silent as to any problems encountered with packaging of garments due to wrinkling, or any treatment to avoid wrinkling. There is no vacuum packaging apparatus disclosed in Vanderpool.

The art, therefore, is silent on utilizing a packaging apparatus which will eliminate the possibility of wrinkling as would be encountered in garments; more particularly, as described hereinafter, applicant has found that by removing air from a package containing a garment, and where the air is displaced from the package outwardly from generally the central point thereof, many advantages can be achieved which adhere to forebeen impossible to achieve.

The packaging of various types of commodities, particularly consumer goods, is an accepted fact in the manufacture and distribution of such goods between the point of manufacture and the locus of distribution. As such, transportation and handling costs have, in recent years, increased significantly and as a result, the cost of goods where the latter have to be transported and handled, has increased due to the increased cost in transportation and handling. Transportation costs, as well as handling costs, are not only dependent on the weight of such products but also, on the volume of space such goods occupy. Thus, in the case of bulky goods, it has been recognized that the concept of reducing the bulk or volume of such goods for transportation and handling purposes, can reduce the overall costs and lead to a much more efficient transportation and handling arrangement. Proposals have been made in the prior art for reducing the volume of bulky goods and reference may be had to, e.g., U.S. Pat. No. 3,511,021 which refers to the fact that it is desirable to reduce the volume of bulky goods for such purposes. However, heretofore, no practical system has been evolved for use in the manufacturing field where the manufacturer can package the goods with apparatus which reduces the volume of the goods, possibly for several reasons including the fact that prior art proposals for such purposes have not led to efficient systems or such systems as have been proposed previously have been more complex than is normally required for the packaging art.

At the present time, most commodities, particularly consumer oriented commodities, are in fact packaged for shipment from a manufacturer to a distribution point and thus, packaging of materials has long been accepted in this art for protecting the goods or commodities from damage during transportation or handling. The extension of the concept of packaging goods, to reduce the bulk volume, is thus one which is going to be more and more required in the future as transportation and handling costs increase due to rising labour and fuel costs. Thus, it would certainly be desirable for manufacturers if they could utilize an efficient and economical system for packaging commodities which are normally bulky but which are capable of compression.

With this invention, according to one embodiment thereof, applicant has developed a system and a method for packaging commodities which are of a relatively bulky nature, and which are capable of compression to a fraction of their original size and yet, which may be reconstituted upon removal of the packaging, to their original state and which method and system permits a greater number of commodities to be packaged in a shipping container or the like for transport to distribution points.

According to one aspect of the device there is provided a system which may be used in the process above for conditioning a commodity such as a garment, a cushion, or the like, to provide a conditioned garment having a relatively low humidity and a temperature of below about 30° C., means for enveloping the commodity with a packaging material to form a wrapped commodity, means for vacuum packaging the wrapped commodity, said last-mentioned means comprising means for compressing the commodity and for removing air from the packaged commodity by progressively compressing the commodity from the central portion outwardly towards the periphery of the package. Correspondingly, there is provided a method which comprises the steps of conditioning a commodity, such as a garment or the like, to provide a stabilized and conditioned garment having a relative humidity of less than about 15% and a temperature of less than about 30° C., enveloping said commodity with a wrapping material, and subsequently vacuum packaging the wrapped commodity by compressing the commodity under a partial vacuum, initially in the central area of the commodity and progressively outwards therefrom.

In the present an apparatus for wrapping and vacuum packaging a substantially compressible commodity comprising means for supplying a substantially compressible commodity to a wrapping station; means for supplying flexible, air impermeable wrapping material having opposed wall sections to said wrapping station from a continuous length source; and means for enveloping the compressible commodity with said wrapping material such that an unsealed open mouth of said wrapping material extends beyond the compressible commodity thereby forming an open mouthed commodity-containing bag; means for advancing the commodity-containing bag to a vacuum packaging station having a flexible membrane and a substantially co-extensive opposed surface defining therebetween a commodity receiving area for receiving a commodity-containing bag, supporting means having first and second sections with said first section being spaced furthest from said opposed surface and the second section being spaced closest to said opposed surface, the flexible membrane being peripherally supported by the first section of the supporting means and the central portion of the membrane being unsupported between the first and second sections, the flexible membrane being a resiliently flexible, inwardly deformable one piece sheet material, means for bringing the membrane supporting means and the opposed surface substantially into engagement with each other whereby a chamber is formed for containing the open mouthed commodity-containing bag so that displacement of the air from the bag can be effected, vacuum means for evacuating the chamber to cause inward deformation only of the flexible membrane towards the opposed surface to cause displacement of airfrom an open mouthed commodity-containing bag, the deformation commencing in the central portion and subsequently progressing outwardly therefrom so as to reduce entrapment of air in the commodity-containing bag, and means for sealing the open mouth portion of the commodity-containing bag.

In the present invention the conditioning apparatus may have an elongated chamber having a treatment zone and a stabilizing zone, with the chamber being enclosed in said zones and with the zones being in communication with each other. The chamber includes a loading or receiving port in communication with the treatment zone for receiving a commodity to be conditioned, and a discharge port for discharging the conditioned commodity for subsequent processing in the wrapping system. The discharge port is in communication with the stabilizing zone, and conveying means are provided in the chamber for receiving a commodity at the loading or receiving port and for transporting the commodity between the loading and receiving port to the treatment and stabilizing zones and subsequently to the discharge port. The apparatus includes means for providing a source of conditioning air, as otherwise defined herein, having a predetermined relative humidity and temperature requirements, and for introducing a flow of the conditioning air into the treatment zones. There is also provided means for introducing a flow of the air into the stabilizing zone and means for removing the treatment and stabilizing zone spent conditioning air.

In this conditioning apparatus, the conveying means preferably comprise an endless conveyor adapted to mount and retain an individual commodity and to transport the same to and through the conditioning and stabilizing zones from the loading to the discharge ports. Any suitable conveying means may be provided for this purpose but preferably, such conveying means comprise means for vertically mounting a commodity to be conditioned and for transporting the commodity in a vertical condition between the loading port and the discharge port. A particularly preferred embodiment utilizes an endless conveyor which includes means for loading a commodity to be conditioned onto the conveyor and means for discharging the conditioned article from the conveyor at the discharge port.

Still further, preferably there is included a retention chamber operatively associated with the discharge port whereby conditioned garments may be retained in the retention chamber after being discharged from the conveying means at the discharge port of the stabilizing zone, for the purpose of maintaining the conditioned articles in a conditioned state for subsequent processing in the wrapping operation. Thus, depending on the speed of the wrapping operation or other factors in the overall system, conditioned articles may be stored until required and preferably, the conditioning factors are maintained at a relatively constant relative humidity and temperature in the retention chamber.

The conditioning apparatus may take the form of an elongated continuous tunnel, the length of which will depend on several factors such as the type of garment being conditioned, the capacity of the conditioning chamber, etc. Typically, in the case of garments such as coats, jackets or the like, the overall length of the conditioning tunnel or chamber may be between 5 to about 40 meters and will be appropriately dimensioned to receive such garments. The conditioning system need not necessarily be closed at the loading port where a commodity enters the conditioning system and for this purpose the overall conditioning apparatus may include different stages in each of the treatment and stabilizing zones. Thus, for example, two or more stages may be provided in the treatment zone and similarly, in the stabilizing zone. Each stage preferably includes separate means for introducing a flow of conditioning air into the stage, means for withdrawing spent conditioning air at that stage, and means for providing a substantially balanced flow of conditioning air between the means for introducing the conditioning air and the means for removing the conditioning air. Thus, in effect, each stage may have its own balanced air flow system. The number of stages required for each of the treatment or stabilizing zones will depend on the type of garment being treated, the capacity of the overall system and the like. Thus, from two to several stages may be employed in the treatment zone while several stages may be employed in the stabilizing zone to place the garment being treated in a stabilized condition at the point where it is discharged from the system.

The treatment and stabilizing zones also include in a preferred arrangement, means for circulating the conditioning air in each stage and thus, circulation fans or other like means for circulating air in each stage may be provided.

The means for supplying conditioning air comprises suitable means for providing a source of air, treating the air to provide conditioned air having a relative humidity of less than about 30% and at a temperature of below about 30° C. Such air may be introduced into the respective zones of the conditioning system or at the respective stages—or according to a further alternative, at a common source with a direction of air flow through the complete system from the stabilizing zone to the treatment zone.

In the conditioning apparatus and with the conditioning method of the present invention, commodities such as garments or the like may be suitably conditioned for vacuum packaging, and which garments following removal from their vacuum package for use by consumers or the like, return substantially to their original condition and which are free from wrinkling or other undesirable effects of vacuum packaging.

Moreover, it has been found that with the conditioning system and method of the present invention, conditioning can be carried out in a relatively short period of time and typically, from 30 minutes to 2 or 3 hours with 1 hour being normal for garments such as coats, jackets, suits or the like. To achieve this shortened period of time for conditioning compared to prior art procedures, the conditioning apparatus and method utilize a mixture of ambient air and conditioned air which has been treated to remove the relative humidity and to cool the air at the same time. Thus, ambient air and treated air may be employed to provide a much lower conditioning time than has previously been proposed and the use of such mixtures of air in which the mixed air has a temperature of 30° C. or less (within the range of 30° C. to about 5° C.) and relative humidity percentages of 40–5% may be appropriately used. Suitable dehumidifying and cooling apparatus conventional in those arts may be employed for the purpose of providing the cooled and dehumidified air and mixing of the air within the conditioning system, or in a separate chamber, may be employed to achieve the desired results.

The wrapping assembly for enveloping a commodity in broad terms may comprise supply means for supplying a length of wrapping material having opposed wall sections, means for engaging and maintaining the opposed wall sections of the leading portion of the wrapping material in a spaced apart manner to form an open-top enclosure adapted to receive a commodity, means for advancing the wrapping material with the walls in a spaced apart manner from an initial starting position to a second or terminal position along a predetermined path, means for mounting a commodity to be enveloped by the wrapping material in the predetermined path so that when the advancing means advances the material from the first or initial position to a second or terminal position, the commodity is enveloped by the material as the material advances between the first and second positions.

In greater detail, according to preferred forms of this embodiment, the supply means for supplying a length of wrapping material preferably comprises supply means for supplying a length of tubular wrapping material. As explained herein, the present invention can envelop a commodity such as a garment or the like in a continuous length of tubing and for this purpose, the wrapping assembly has been specifically developed to provide an apparatus capable of utilizing a continuous tubing for the wrapping material. Thus, the wrapping assembly functions to envelop a commodity as opposed to the more conventional system of utilizing means for inserting a commodity into a wrapping bag.

The wrapping assembly can be vertically oriented particularly for wrapping commodities such as garments or the like which may be suspended in a vertical or the like which may be suspended in a vertical mode. In the case of garments such as suits, coats, or the like which have sleeves, the wrapping assembly may include additional embodiments for aiding in the placement of the sleeves for packaging purposes. To this end, a pair of movable arms adapted to "tuck" the garment arms into a packaging position may be provided and which arms are movable about fixed axes to "tuck" the garment sleeves into position prior to advancement of the tubular material from the initial to terminal position. Still further, on the upstream side of the gripping or vacuum means in the direction of travel of the tubular material, there may be provided a mouth or guide in the form of a trough or the like converging from a wider mouth portion to a narrower discharge portion for initially receiving the garment or commodity to be packaged and for guiding the same into the tubular wrapping material as the latter advances. Still further, appropriate air or air jet means may be provided for directing a continuous source of pressurized air against the garment to ensure that the sleeves or other portions of the garment are maintained in proper alignment for entry into the tubular material. Finally, compression rollers exerting a slight compression may likewise be provided on the movable assembly so that the garment is properly inserted into the wrapping material. Such rollers may be driven in response to the speed of the movement of the assembly and may be mounted for engagement of the garment, during packaging, on the advancing stroke but releasable, if desired, on the return stroke.

The wrapping assembly can include means for mounting a commodity to be enveloped by the wrapping material and such means may be, for example, a hanger or the like capable of suspending a garment in the direction of travel of the tubular material. Such means may temporarily or fixedly secure the garment in the desired position during the wrapping operation and subsequent operations—i.e., the mounting means may form a portion of the wrapping station or be a portion of a continuous conveying system for moving the garment or commodity between the different work positions of the overall system. In a preferred embodiment, the means for mounting the commodity are a portion of a transport system as described herein.

Still further, appropriate means such as described herein, may be employed for delivering a commodity or garment to the wrapping assembly and normally, during the delivery of such garment, motion of the commodity is encountered upon its placement in the wrapping assembly. For this purpose, dampening means may be employed for reducing the movement of the commodity upon delivery to the wrapping station and such means may comprise somewhat flexible brushes or the like against which the commodity abuts upon delivery to the wrapping station.

Referring now to the transport embodiment, this system is basically intended to transport a work product from one station to a subsequent processing station and in particular, with regard to other embodiments of the present invention, from the wrapping assembly to the vacuum packaging assembly. A transport device can be used to advance a commodity between processing stations; it may comprise guide means between the processing stations, a pair of opposed gripping means movably mounted on the guide means, means for advancing the spaced apart gripping means between the first and second processing stations and means for reciprocating each of said gripping means into and out of package-engaging and package releasing positions at said first and second stations.

The gripping means engages the tubular wrapped commodity at the wrapping assembly when the tubular material is advanced to a second or terminal position of the wrapping operation. Thus, the gripping means of the wrapping assembly, as previously described, are effective to advance the tubular material to envelop the commodity and bring it to a position above the commodity. At this point, the open-topped enclosure may be engaged by the gripping means of the transport assembly and preferably, such gripping means are inserted into the open-topped tube and the means for reciprocating the gripping means is actuated to bring the gripping means of the transport assembly into tube-engaging relationship. As such, therefore, the gripping means of the transport assembly may be advanced between the processing stations and retain the packaged commodity in a desired configuration.

The vacuum packaging assembly of this invention is adapted to receive a wrapped commodity and to evacuate the air from within the bag containing the commodity and at the same time, to compress the commodity to a fraction of its original volume. To this end, the vacuum packaging system operates on the principle of a vacuum while at the same time compressing the commodity. In brief summary, the vacuum packaging system includes a first fixed generally planar air impermeable surface, a second opposed flexible air impermeable surface, means for bringing the surfaces into and out of sealing engagement, and sealing means defining between the surfaces for forming an airtight chamber between said surfaces, with means for creating a partial vacuum in the chamber formed between the opposed surfaces.

In the vacuum packaging apparatus, the flexible wall is arranged to provide a particular type of packaging operation wherein, upon drawing a partial vacuum in the chamber formed by the flexible and solid walls or surfaces, the flexible wall is effective to initially contact the central portion of the package containing the commodity and to progressively compress the commodity and remove air from the package from the central portion outwardly towards the edges of the package. It has been found that this is very critical to obtain a proper vacuum packaged commodity and thus provide an effective vacuum package.

In greater detail, the vacuum packaging apparatus may have either one or both of the flexible and rigid walls movable into and out of engaging relationship; however, only one wall may be movable relative to the other if desired. The rigid surface or wall may merely be a fixed plate rigidly secured to a suitable frame member and may be made of any appropriate material for this purpose. On the other hand, the flexible air impermeable surface may be made of any material possessing the desired characteristics including air impermeable cloth, rubber, sheet plastic material or the like. Such material may be fixedly secured about its periphery to a suitable frame member with a sealing gasket or other like sealing structure being provided adjacent the edges of the flexible wall (or of the fixed wall) to define a vacuum chamber when the two walls are brought into operative relationship. The pair of walls forming the chamber are dimensioned so as to be substantially coextensive at least in the area where the packaged garment is to be subjected to the compressing step.

In a preferred embodiment, the vacuum chamber includes sealing means for sealing the top portion of the bag containing the commodity subsequent to the vacuum packaging step. Such sealing means are preferably mounted within the vacuum chamber and form a portion thereof. To this end, a pair of sealing heads, one mounted to each of the respective walls or surfaces of the vacuum chamber, may be provided and means for reciprocating one or both sealing heads into and out of sealing engagement with the packaging material may be provided. Any suitable means may be provided for creating a partial vacuum within the chamber and such means are well known to those skilled in this art.

The vacuum packaging device will include means for mounting a packaged commodity within the chamber and to this end, the means associated with the transport system may be employed for this purpose. Thus, by virtue of the hanger or carrier means of the transport system, which in turn suspends or mounts a device of the type previously described containing the heat sealable ligament, the packaged commodity may be aligned in the desired position within the vacuum chamber with the flexible ligament being located at least partially within the package so that upon actuation of the sealing means for the package within the vacuum chamber, the sealing means is effective to provide an airtight seal with the commodity being suspended in the resulting package by virtue of the heat sealable ligament.

In an alternate arrangement, either one or both of the rigid and flexible walls or surfaces may be pivotably mounted about a pivot on one side whereby, in place of bringing the walls into and out of sealing engagement as described above, the walls may be pivoted into sealing engagement.

The transport system previously described for use in transporting a packaged commodity between the wrapping system and the vacuum packaging system can be used to control the positioning of the packaged commodity at the vacuum packaging station. To this end, the gripping means associated with the transport system may align the packaged commodity in a proper sealing relationship with the sealing means and thereafter, following sealing, the gripping means may be brought out of engagement so that the carrier means of the transport system may assume control. Still further, the resulting vacuum packaged garment may then be off-loaded onto a further conveying system for distribution to a packaging station, depending on the particular arrangement employed and the type of commodity.

The conditioning system and method used in the present invention provides many advantageous features over comparable prior art conditioning systems. Thus, the conditioning system of the present invention provides conditioned garments in a relatively short period of time and makes it practical for the complete system, including the wrapping and vacuum packaging aspects, to be set up on an inline basis with other commercial operations—e.g., suit or coat manufacturing processes whereby such commodities, after they are manufactured, may be directly passed into the packaging system. In a similar manner, the vertically oriented wrapping system of the present invention provides many advantageous features over other systems; for example, the use of tubular packaging material may be employed and varying types of garments can be packaged using a continuous tube. Moreover, with the vacuum packaging method and apparatus of the present invention, a very good vacuum package is obtained with very little chance of any entrapped air being retained in the garment.

The packaging material used to package or envelop the commodities may be any suitable flexible substantially air impermeable material. Such materials are known in the art and generally, they may comprise single layer or multi-layer plastic or plastic hybrids or even metallic foils. By way of example, single layer or multi-layer plastic wrapping materials of a flexible nature, and which are substantially air impermeable, are known and generally comprise the polyolefins, in either homopolymer or copolymer form, and according to more recent developments in the packaging art, such materials may be in the form of laminates of two or more extruded layers of the same or different material. Typically, such plastic materials may be polyamides, polyolefins or the like and comprise ethylene homo- and copolymers, propylene homo- and copolymers, and more complex polymers or copolymers of mixtures of these two olefins or other resins. Laminates are coming more and more into usage in this field as packaging materials due to the fact that different properties may be combined into a single wrapping or packaging film by combining the properties of one film with another to provide an overall desired packaging material with the requisite properties. Still further, other packaging materials may comprise plastic backed or coated (one or both sides) paper materials and in other cases, paper or plastic backed metallic foils such as aluminum foils. The choice of any particular wrapping material will depend on the particular type of properties desired in the packaging material and such choice is well within the skill of those skilled in this art. It suffices to say, however, that the material should be flexible and must possess the desired degree of air impermeability due to the nature of the vacuum packaging concept of this invention. In utilizing the packaging material, and according to the preferred embodiments of the present invention, the packaging material is provided in the form of an endless tube from which the requisite packaging envelopes or bags are formed, but it will be appreciated that within the broader context of the invention, the bags may be preformed or even a system employing sheet material may be used in which the sheet material is side and end sealed to form the bags during the process.

The type of commodities which may be packaged according to the various embodiments may vary considerably. It is contemplated that a most desirable field of application of the present invention relates to the packaging of relatively bulky or voluminous products which are consumer oriented, such as clothing or other articles of wearing apparel, sheet material such as bed coverings, cushions or pillows or the like, etc. In the case of clothing, successful tests have been carried out using overcoats, sweaters, shirts, jackets (particularly sports jackets such as ski jackets), suits, etc. Pillows or the like have also been successfully tested according to the embodiments of this invention and depending on the initial bulk of the material, and the type of material from which the garments or the like is made, such products can be compressed to a fraction of their normal volume using the techniques of the present invention. The products which are packaged according to the present invention may be made of any natural or synthetic material capable of being compressed.

Having thus generally described the invention, reference will now be made to the accompanying drawings, illustrating preferred embodiments and in which:

FIG. 10 is a partial view of the drive system used in the wrapping device of the present invention;

FIG. 11 is a partial detailed view of the cutting and sealing assembly used in the wrapping operation;

Figure 1:
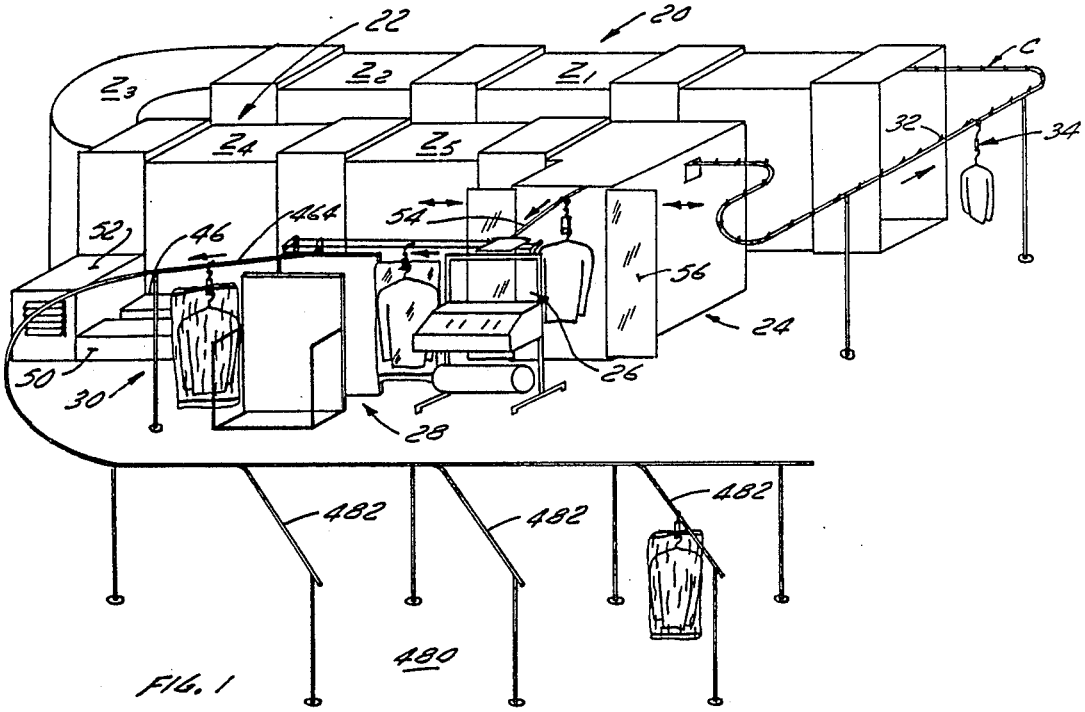
FIG. 1 is a schematic overall view of the 5 apparatus of the present invention.

Referring now to FIG. 1, an overall system is illustrated and comprises, in general terms, an initial conditioning section indicated by reference numeral 20; a stabilizing section indicated generally by reference numeral 22; a retention zone indicated generally by reference numeral 24; a wrapping station indicated generally by reference numeral 26; a vacuum packaging zone 28 and a discharge zone 30.

Initially, products to be wrapped, such as suits or the like (as illustrated in the drawings), are suspended on appropriate hangers or the like (as described hereinafter in greater detail) at a loading station. The loading station comprises a continuous conveyor having flights 32 thereon each adapted to engage a hanger suspending the article (the hanger being indicated by reference numeral generally) and which advances the goods to be wrapped into and through the conditioning and stabilizing zones. Thus, the conveyor indicated by reference letter C enters the conditioning and stabilizing zone and exits therefrom in the form of a closed loop.

Figure 2:
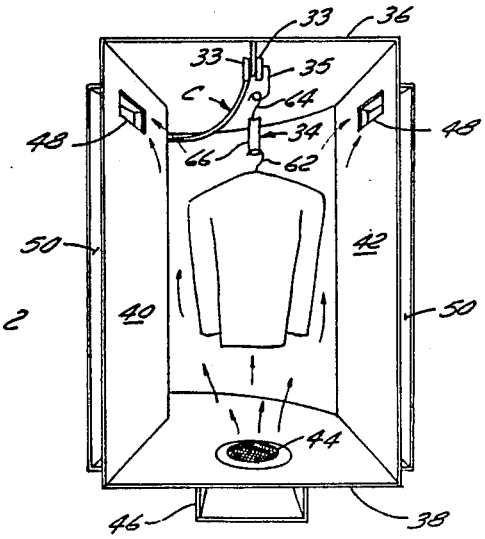
FIG. 2 is a section taken through a portion of the conditioning tunnel of the device.

According to a first embodiment the conditioning zone comprises a series of stages or stations, one of which is illustrated in greater detail in FIG. 2. Each station is a portion of a tunnel defined by spaced apart upper and lower walls 36 and 38 joining a pair of opposed side walls 40 and 42 to form an enclosure therebetween. At each particular zone, an inlet 44 is provided for introducing treated air supplied from a main air system. The treated air enters the zone via a conduit 46 and exits from that zone via outlets 48 entering into a collector system 50 which in turn is circulated back to the air treatment device 52. At the air treatment device, the air is conditioned to provide the requisite temperature and humidity as described herein. Each zone or station in the conditioning system and the stabilization system is provided with inlets 44 and outlets 48 to provide a generally balanced flow of air and to progressively treat the articles to be packaged.

In the particular apparatus illustrated, the conditioning system may include e.g., two or three conditioning zones as indicated by reference letters Z1 and Z2, in which the zones are provided with the structure of FIG. 2. Upon entry into the conditioning zones, the conveyor C merely transports the articles into the open tunnel. Following zone Z1 forming a portion of the conditioning zone, the balance of the system through to the storage or retention area for the garments, prior to wrapping and vacuum packaging, forms a conditioning zone in which the treated articles are retained under generally stabilized temperature and relative humidity conditions (as explained herein) to provide an article having the desired stabilized properties for subsequent treatment. Thus, the stabilizing portion of the system may include zones Z3 through Z5 each likewise being provided with air inlets and discharge conduits similar to that of FIG. 2 for the purpose of providing the conditions required for stabilization treatment.

The conditioning and stabilizing tunnels form a continuous closed system and may take the form of an elongated tunnel or as shown in the drawings, a "U-shaped" arrangement to reduce the space required.

At the retention zone, the stabilized articles are maintained under the desired humidity and temperature conditions for subsequent wrapping and vacuum packaging; to this end, the conveyors discharge the articles from the conveyor C by any suitable means onto a feeding line 54 where the wares are stored until required. In this respect, the retention area 24 is provided with a pair of sliding doors 56 which are operatively associated with the wrapping station to permit a single article to be discharged from the retention zone when required for the wrapping stage. Thus, the doors are adapted to reciprocate into open and closed positions. Suitable means may be provided for advancing a treated article retained in the retention area to the wrapping station and as such, such means are known to those skilled in the art and need not be described in detail.

Figure 3:
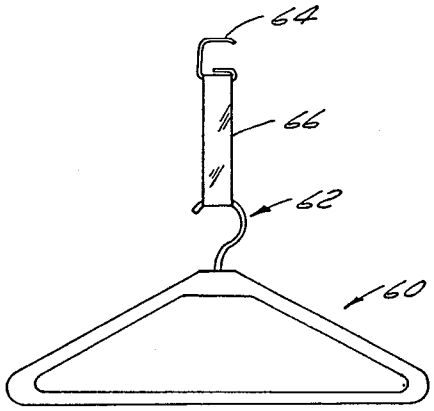
FIG. 3 is a first version of a garment mounting device for use in the system of the present invention.
Figure 4:
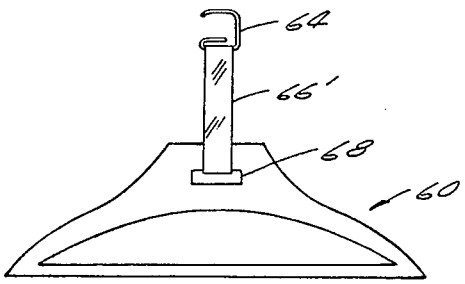
FIG. 4 is an alternate version of the device of FIG. 3.

Referring now to FIGS. 3 and 4, two versions of suitable mounting means for articles such as clothing, for use in the system of the present invention, are illustrated. Each includes a suitable "hanger" shaped body for mounting e.g., coats, suits, sweaters or the like and indicated by reference numeral 60 with, in the case of the embodiment of FIG. 3, a wire or like member 62 projecting from the top thereof. The hook member 62 is connected to a further hook member 64 which is adapted to engage the conveyor system and, as subsequently described hereinafter, a transport system for mounting the garment in the various stations. Connecting the hook members 62 and 64 is a special type of ligament 66 which, according to this invention, is comprised of a heat sealable, preferably flexible, material. This ligament is adapted to be sealed in and form a portion of, the wrapped package about the borders of the package where the latter is sealed. In the embodiment of FIG. 4, the ligament is incorporated into a portion of the hanger 60 so as to provide direct mounting of the hanger 60 to the hook member 64 so that the ligament 66', passing through a slot 68, takes the place of the hook 62 in FIG. 3.

Figure 5:
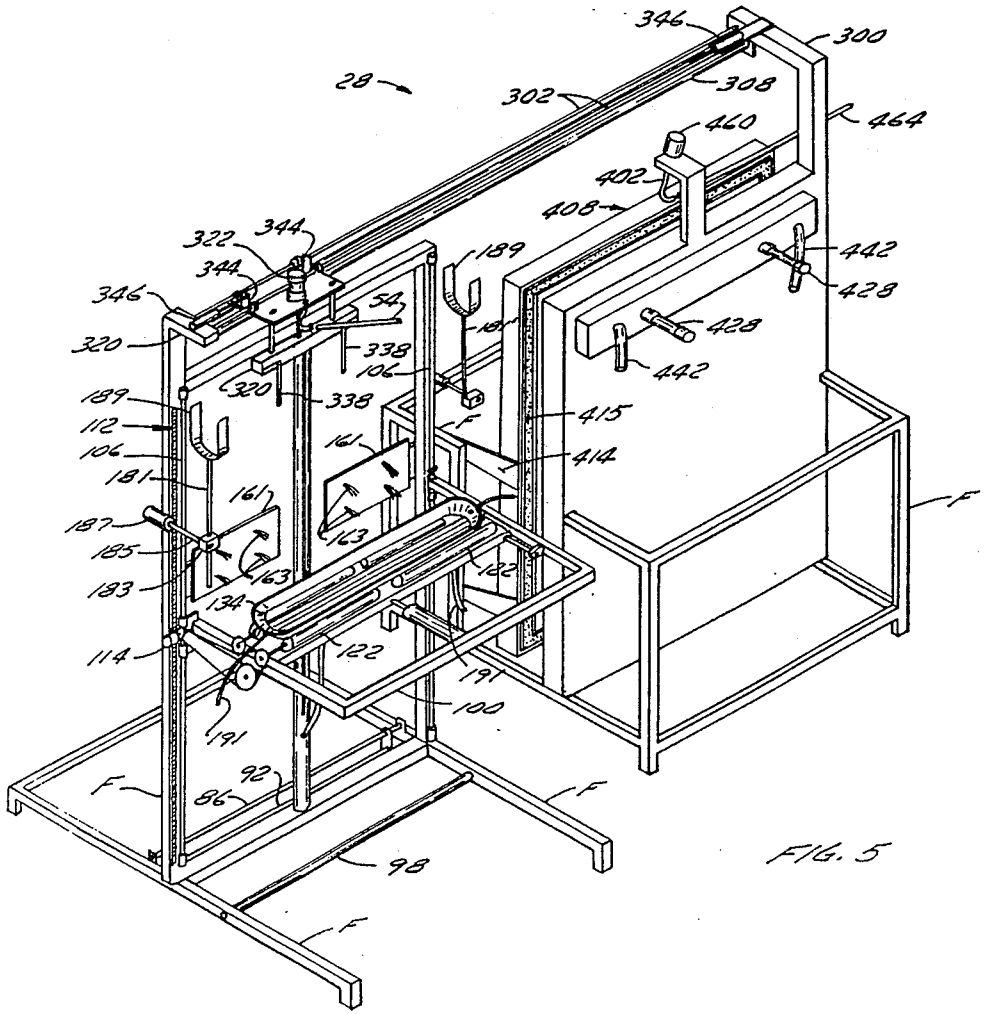
FIG. 5 is a schematic view of the wrapping device together with the vacuum packaging unit.

Referring to FIG. 5, and related figures, a wrapping apparatus invention is illustrated and includes frame members indicated by reference letter F mounting various components.

The material supply system for enveloping or wrapping a commodity, according to a preferred embodiment, comprises an "endless" synthetic plastic tube which is indicated generally by reference numeral 70, and which is mounted (rotatably) on a pair of drive rollers 72. Drive rollers 72 are mounted by means of shafts to the frame F and each shaft is provided with a gear 74. Motor 76 is provided with drive shaft 78 extending therefrom into a gear box 80 and which contains an output gear 82. Drive belt 84 engages each of the gears 74 and 82 to rotate the pair of shafts 72 and thus the roll of packaging material 70.

Figure 7:
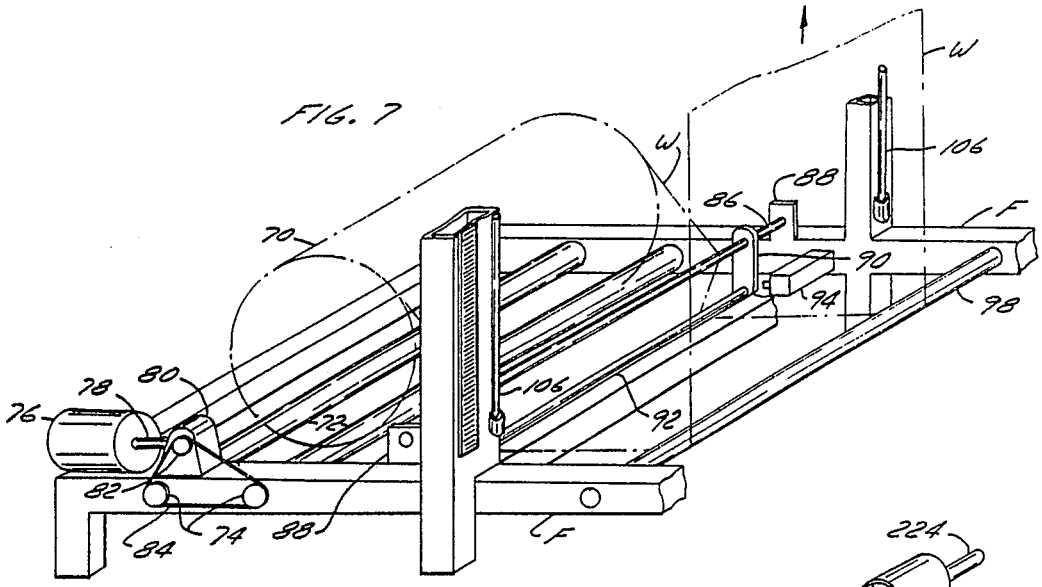
FIG. 7 is a schematic view of the lower portion of the wrapping zone showing the feeding system for the wrapping material.
Figure 8:
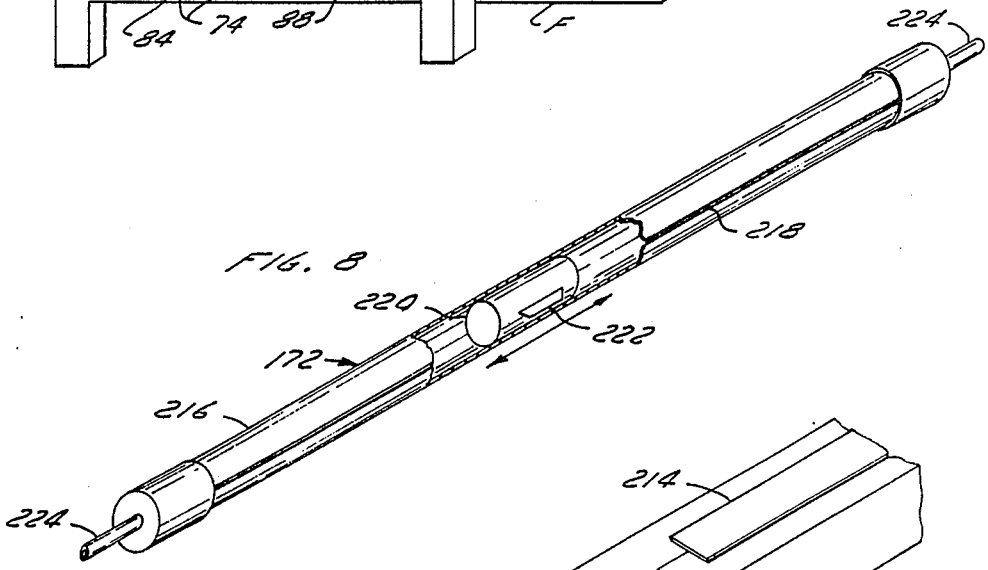
FIG. 8 is a detailed view of the cutting device for use in the wrapping apparatus.

Mounted in operative relationship in the direction of feed of the wrapping material is a guide shaft 86 rotatably journalled in a pair of mounting brackets 88, over which the web W passes in the direction of feeding of the same to the wrapping system. Fixedly secured to the shaft 86 is a pair of mounting brackets 90, one of which is shown in FIG. 7, journalling a shaft 92 therebetween. The shaft 92 is thus free to rotate about the axis of shaft 86. Mounted in operative relationship to the rotation of the shaft 92 is a suitable actuation means for the motor 76 such as a microswitch 94 so that upon rotation of the shaft 92, due to the advancement of the web W in the direction of feeding, the shaft 92 or the mounting bracket 90 is effective to abut the microswitch 94 to initiate the drive of the motor 76 to thereby rotate the shaft 72 and advance a predetermined amount of web material from the roll 70.

Upon advancement of the wrapping material W from the roll, the material is passed under a guide bar 98 journalled between the frame members F and which positions the web W in vertical alignment for the wrapping operation as described hereinafter.

The wrapping unit includes a vertically movable web advancing, sealing and cutting assembly which is generally shown in FIG. 5 and greater detail of which is shown in other figures. The assembly includes a movable frame 100 capable of being raised and lowered by means of a pneumatic cylinder system indicated generally by reference numeral 102 and which includes a connecting rod 104 fixedly secured to the frame member 100 of the wrapping assembly. Thus, the pneumatic system 102 permits raising and lowering of the system between first and second positions. The frame member 100 is vertically guided on guide rods 106 on either side of the assembly by means of guide bushings 108 mounted on the frame 100. Frame member 110, mounted at the rear of the wrapping unit, includes a rack and pinion drive system indicated generally by reference numeral 112 with the pinion 114 being rotatably journalled to the frame member 100 and being placed in engagement with the rack 116. Thus, upon movement of the frame 100 from the lower to upper position, the pinion 114 is driven. Mounted on the shaft 118 for the pinion is a further drive pulley 120 which is thus rotated by the rotation of the pinion 114 and which in turn, serves to drive feed rollers 122. This is accomplished by means of a rotatable gear wheel 124 mounted on an extension of the frame member 100 and with each of the rollers 122 being provided with an outwardly extending shaft 126 on which is fixedly secured a drive wheel 128. Belt 130 extends about the drive wheels 124, 128, and 120, whereby movement of the frame 100 in a vertical manner will thus rotate the rollers 122.

To aid the feed rollers in guiding an article to be enveloped or placed between the opposed walls of the endless tube, there is provided a converging trough indicated generally by reference numeral 134 which is located above the rollers 122 and with the converging mouth aligned generally with the top portions of the rollers 122. The trough 134 is mounted by suitable brackets 136 to the frame 100.

Figure 14:
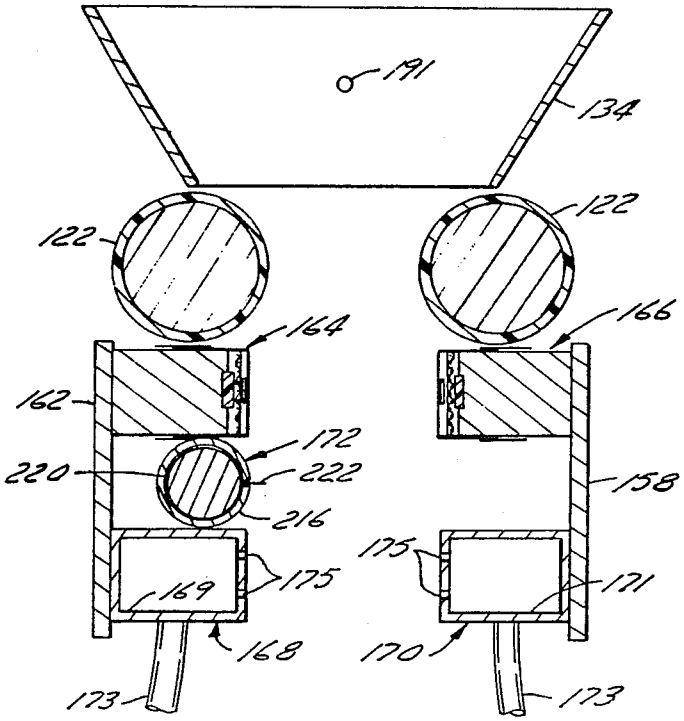
FIG. 14 is a cross sectional view through the sealing, cutting and vacuum device used in the wrapping system of the present invention.

Referring to FIG. 11 further, the frame 100 includes pairs of mounting blocks 140 and 142 for mounting the shaft 126 of the rollers 122; mounted on the frame is a pair (one being shown) of guide rods 144 journalling a sliding sealing and suction head as described hereinafter. The shaft 144 is journalled by means of bushings 146 to the frame 100 and thus permits the vacuum and sealing head to reciprocate inwardly and outwardly towards the pneumatic piston assembly 102 through use of a piston 150 mounting a projecting piston rod 152. The reciprocating portion of the vacuum and sealing head comprises a frame member 154 journalled to the piston rod 152 by means of a clamp 156. Connected to the frame 154 is a further vertical frame 158 (see FIG. 14) which mounts the vacuum and sealing members. In a like manner, as shown in FIG. 14, there is provided a fixedly secured plate 162 mounted to the frame 100 and an upper sealing head 164 cooperating with an opposed sealing head 166 associated with the movable assembly of FIG. 11; in a like manner, there is provided a lower vacuum chamber 168 cooperating with a movable vacuum chamber 170 associated with the movable assembly of FIG. 11. Further, the movable portion of the vacuum and sealing assembly is mounted on the guide rods 144 by means of a pair of bushings 182 each journalled on a respective one of the guides 144 whereby the reciprocation of the piston rod 152 from the piston assembly 150 will cause movement between first and second positions (into and out of engagement as described hereinafter).

In greater detail, the vacuum system shown in FIG. 14 ihcludes a pair of chambers 169 and 171 each connected to a conduit 173 which in turn, is connected to a vacuum source (not shown). The chambers 169 and 171 include apertures 175 (as more clearly shown in FIG. 11 in the form of slits). The construction of the sealing heads as shown more clearly in FIG. 9, includes a body member 200 containing a recess 202 therein for mounting a resilient backing member 204; an overlying wire mesh layer 206 for the purpose of functioning as a heat dissipation material; a backing layer 208 such as a "Teflon" layer; a heating element 210 and a facing 212. Means for securing the facing 212 to the body 200 and for retaining the other components in position are indicated by reference numeral 214 and may comprise a tape or like material.

The cutting assembly for use in the wrapping device of the present invention comprises a generally cylindrical shaft 216 mounted by suitable means (not shown) onto the frame 162. The shaft 216 includes a slot 218 extending from one end thereof to the other; mounted interiorly of the shaft 216 is a movable cylinder 220 mounting a knife or razor edge 222 which projects outwardly which projects outwardly through the slot 218. Thc cylinder 220 is adapted to reciprocate from one end of the shaft 216 to the other by means of pneumatic pressure and to this end, conduits 224 located at either end of the shaft 216 are connected to an appropriate pneumatic system (not shown) and operated by suitable timing means (not shown).

Figure 12:
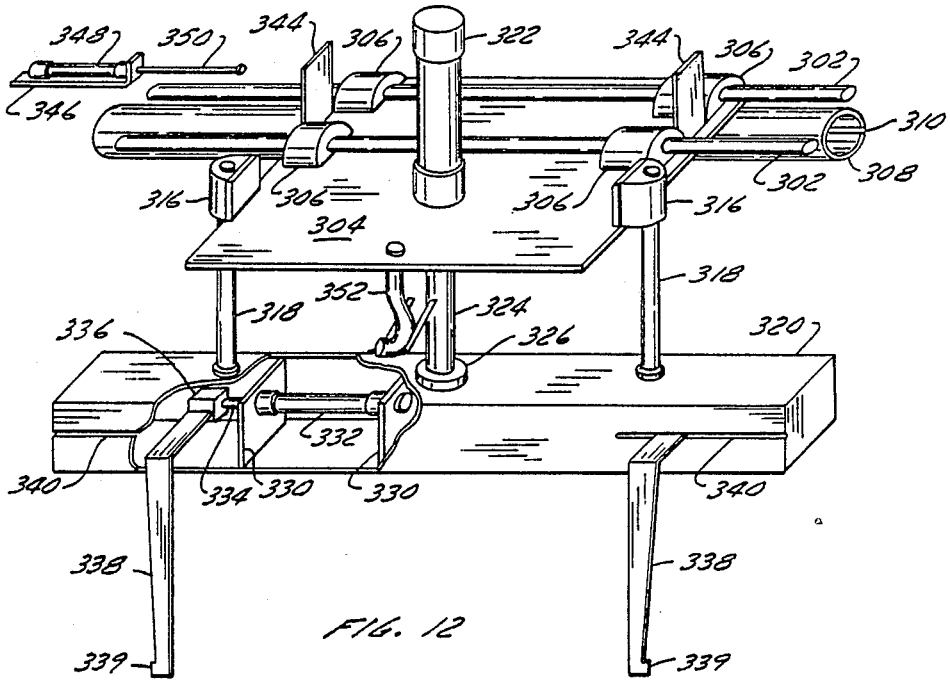
FIG. 12 is a schematic view of the carriage device of the present invention for moving the packaged articles from one station to another.
Figure 13:
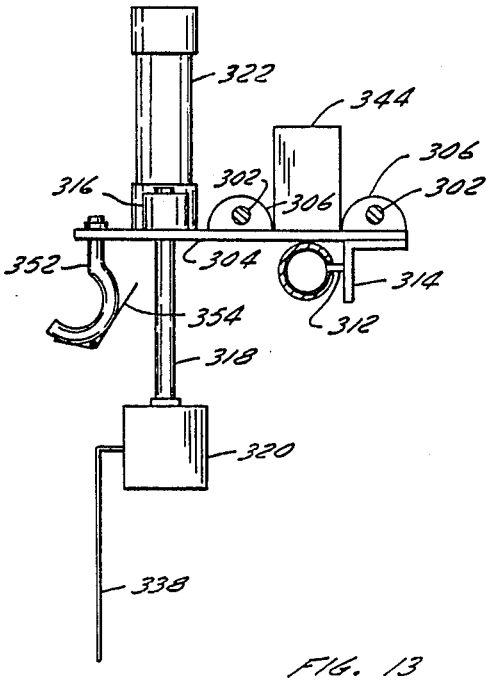
FIG. 13 is a side elevational view of a portion of FIG. 12 showing the means for mounting the packaged material.

Referring now to FIGS. 5, 12 and 13, the transport system according to a further embodiment is illustrated, for moving the commodities between a first station (the wrapping station) and a second station (the vacuum packaging station). This transport system operates in conjunction with the wrapping station and aids in fulfilling a portion of the function of the wrapping station as described hereinafter. To this end, the transport system includes frame members 300 journalling guide rods 302 extending therebetween which in turn, mount a further frame member 304 operatively associated therewith by means of bushings 306 carrying the frame 304. The bushings 306 are free to slide along the guide rails or rods 302 and are driven in a reciprocating motion by means of a piston assembly 308 which contains a slot 310 having a projecting member 312 extending therefrom and which projecting member is driven by the piston assembly 308 to reciprocate the transport system between first and second positions. The piston assembly 308, like the piston assembly 102 of the wrapping station, is known in the art as "Orega".

The projecting member 312, associated with the piston assembly 308, is connected to a frame member 314 which in turn, is fixedly secured to the frame 304 of the transport system. Fixedly secured to the plate 304 are further bushings 316 each slidably mounted on a guide shaft 318 which in turn, is fixedly secured to a housing 320. In a like manner, piston 322 is fixedly secured to the plate 304 with a piston rod 324 extending therefrom and fixedly secured to the housing 320 by means of a bushing 326. In this manner, the piston 322 is effective to raise and lower the housing 320 in a vertical displacement whereby the housing 320 is vertically displaced by guide rods 315 sliding through bushings 316.

The housing 320, a fragmented section being illustrated in FIG. 12, includes interiorly fixedly secured frame members 330 suspending a pneumatic cylinder 332 therebetween with a piston rod 334 extending therefrom and mounting a block 336. Extending from the block in a generally "L" shaped configuration are fingers 338 which include a downwardly extending portion terminating in a small hook 339 so that the fingers 338 are adapted to reciprocate between first and second positions through slots 340 in the housing 320, upon actuation of the piston 332.

In FIG. 12, a pair of vertically aligned fixedly secured plates 344 is shown, which is adapted to act as "stop" plates upon the reciprocation of the transport system and to this end, mounted by means of appropriate frame members is a buffer device 346 which includes a spring loaded cartridge 348 with a projecting movable finger 350. Thus, the finger 350 will abut the plate 344 at each end of the direction of travel of the reciprocating transport system. As illustrated in FIGS. 12 and 13, the transport device includes a carrier means for mounting a commodity and transporting it between the first and second stations and to this end, there is provided a hook 352 which is fixedly secured by appropriate means to the plate 304. In place of a hook, other equivalent arrangements may be employed for this purpose; if desired, the hook may include means for use in removing a garment from the hook at the vacuum packaging station, as described hereinafter.

In operation of the wrapping station, and the transport system, forming two embodiments of the present invention, a commodity such as a garment to be wrapped is discharged from the retention station 24 by means of a sloping rod or guide member 54 which terminates adjacent the hook 352 when the carriage is in the first position at the wrapping station. In this respect, according to a preferred embodiment of the present invention, the conveyor system indicated generally by reference numeral C of FIG. 1 preferably comprises a pair of spaced apart rollers journalled by a shaft rotating on the conveyor and advanced by means of the flights 32. The rollers, indicated by reference numeral 33 in FIG. 2, include a projecting hook member 35 which mounts the hooks 64 (FIGS. 3 and 4( so that when the transfer mechanism (not shown) in the retention chamber 24 discharges the garment to the packaged, the rollers 33 slide down the rod 54 and the rollers are subsequently positioned to straddle the hook as more clearly shown in FIG. 15A. In this manner, once the garment and attendant hook are mounted on the hook 352, the garment is in a position to commence the wrapping operation and appropriate devices may be employed (known to those skilled in the art) for commencing the wrapping operation. In this respect, upon a garment being delivered onto the hook 352, in order to stabilize the garment and dampen the swinging movement which would ordinarily be associated with such a delivery system, and to aid in positioning the garment over the trough, there may be provided dampening means in the form of brushes or bristles such as are illustrated in FIG. 5. To this end, there is included backing plates 161 mounting rolls of bristles 163 so that a garment delivered to the wrapping station will abut the bristles. A particularly preferred embodiment of this arrangement includes the situation where the bristles are flexible and generally slope downwardly so that the garment, when delivered, will abut the bristles and cause them to bend downwardly further and thus, enhance the dampening motion.

Figures 6A, 6B, 6C, 6D, 6E, 6F, 6G:
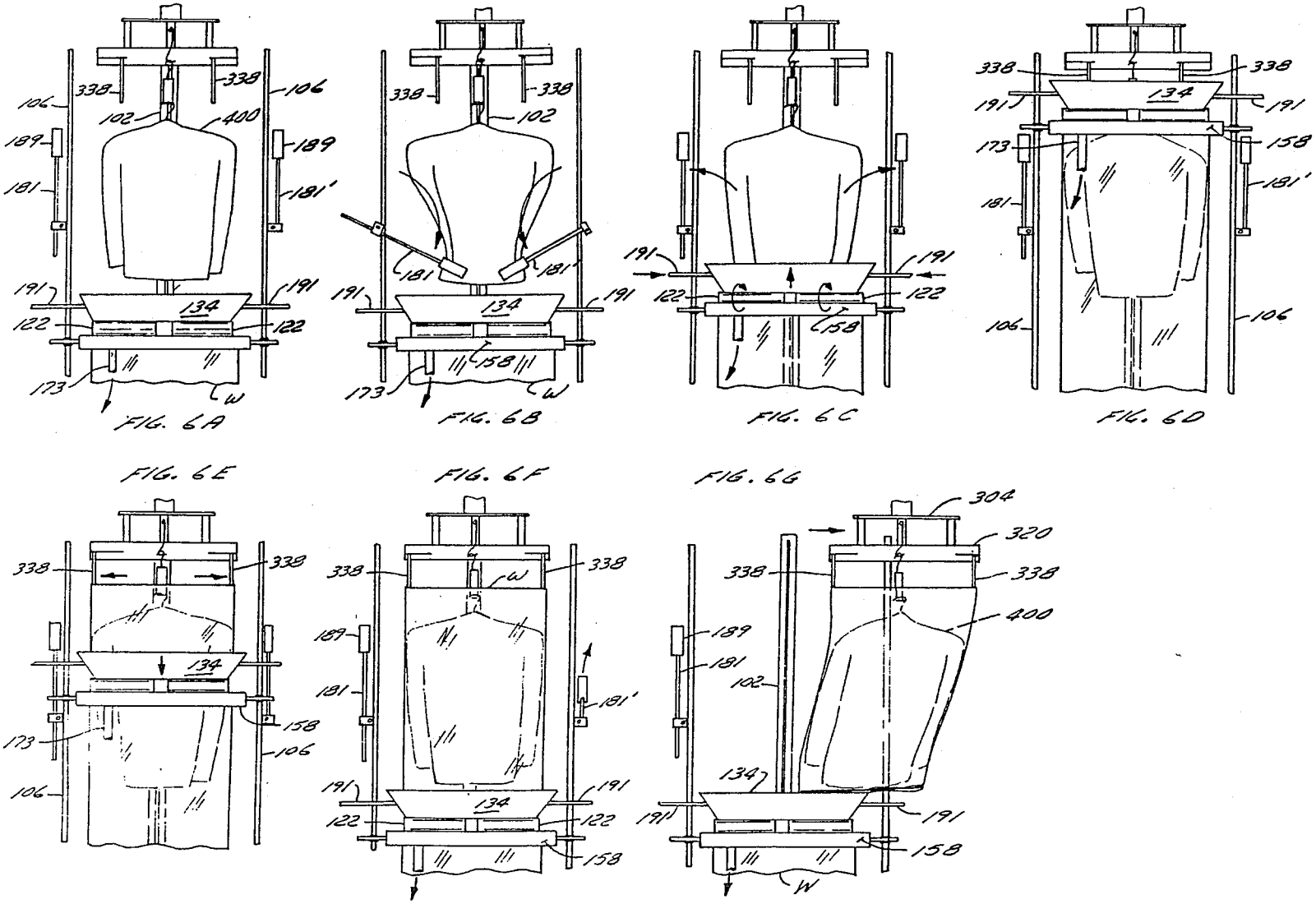
FIGS. 6A to 6G are schematic views of the varying stages of operation for the wrapping device of the present invention.

In commencing the wrapping operation, the movable frame members are in the lowermost position beneath the location of the garment (FIG. 6A). In start-up, or from a previous operation, the endless tube of wrapping material has been brought into engagement with the vacuum heads 168 and 170 with the vacuum on so that each opposed wall of the vacuum is engaged by the respective vacuum heads in a spaced apart manner (FIG. 14), whereby the endless tube has an open mouth which is dimensioned to receive the product to be wrapped. As illustrated in FIGS. 6A through 6G, the product in this case is a coat or jacket 400.

With the vacuum "on", and the tube material being sucked against the respective vacuum heads, means are provided to ensure that the coat arms will enter into the mouth of the trough and to this end, the apparatus may include a pair of spaced apart arms 181 and 181' each mounted in a support member 183 mounted on a rotatable shaft 185 connected to a drive means 187. Each arm 181 and 181' includes a U-shaped channel member 189 fixedly secured to the end of the arms.

When the garment is positioned as shown in FIG. 6A, the arms are actuated by suitable means tied in with the overall control system (not shown) to rotate inwardly as shown in FIG. 6B whereby the direction of rotation engages the respective sleeves of the garment and by further rotation of the arm, presses the arms inwardly and downwardly towards the trough 134 to ensure that the arms of the garment are in a position for wrapping.

At the same time, the assembly as shown in FIG. 11, driven by the pneumatic cylinder 102, commences to move from the lowermost position or first station upwardly as shown in FIG. 6C whereby the assembly advances the endless tube upwardly to draw the tube about the garment. The rollers 122, being rotated by the upward movement of the assembly of FIG. 11, aid in placing the garment in the open-mouthed endless tube. At this point, according to a preferred embodiment, reference will be made to FIGS. 5, 10 and 14 illustrating a further aid for use in ensuring that the sleeves are placed within the trough and correctly aligned for insertion into the mouth of the endless tube; to this end, there may be a pneumatic system employed which contains apair of conduits 191 entering the opposed ends of the trough 134 to direct air jets onto the sides of the garment and particularly the sleeves.

As the movement of the assembly of FIG. 11 advances upwardly in a vertical mode, suitable microswitches or other like means detect the movement and cause the rotation of the arms upwardly into their original position as shown in FIG. 6C. The assembly of FIG. 11 continues advancement up to the uppermost position or second station as illustrated in FIG. 6D, at which point the enveloped garment is wrapped with the envelope extending beyond the garment. The downwardly projecting fingers 338 of the transport system, previously brought into a "closed" position, are then actuated whereby the fingers are extended outwardly or laterally to engage the side edges of the continuous tube as illustrated in FIG. 6E. At this point, the fingers then assume control of the endless tube with the garment therein and the assembly of FIG. 11 commences downward movement. It should be pointed out that the vacuum to the vacuum heads is cut when the fingers have assumed control of the endless tube to permit the downward movement of the assembly of FIG. 11 without pulling the endless tube outwardly.

Upon arrival of the assembly of FIG. 11 at the lowermost or first position, the assembly of FIG. 11 is actuated to sever and seal the lower portion of the endless tube to thereby form the bottom of a bag. In this operation, the vacuum of the vacuum heads is re-established to engage the opposed walls of the continuous tube and subsequently, the heat sealing and severing operations are performed by reciprocation of the piston assembly 150 bringing the sealing head 166 into engagement with the sealing head 164 and by actuation of the movable knife means 172. The purpose of re-establishing the vacuum at the lowermost position is to retain control of the endless tube once the bottom of the bag has been sealed and severed.

Subsequently, the arm 181' is rotated at 90° to the vertical behind the wrapping unit to permit the transport system to transport the wrapped or enveloped garment from the wrapping station to the vacuum packaging station (FIGS. 6F and 6G). Thereafter, the wrapping station is ready to receive a further garment to be wrapped upon return of the transport system.

Figure 16:
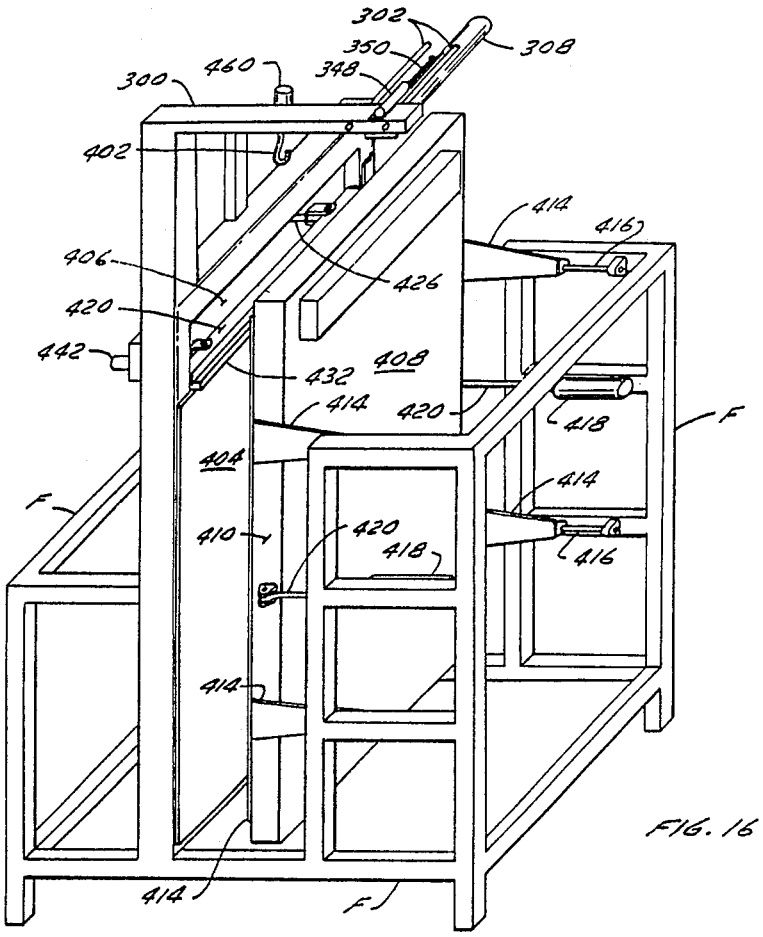
FIG. 16 is a perspective view of the vacuum device of the present invention.
Figure 17:
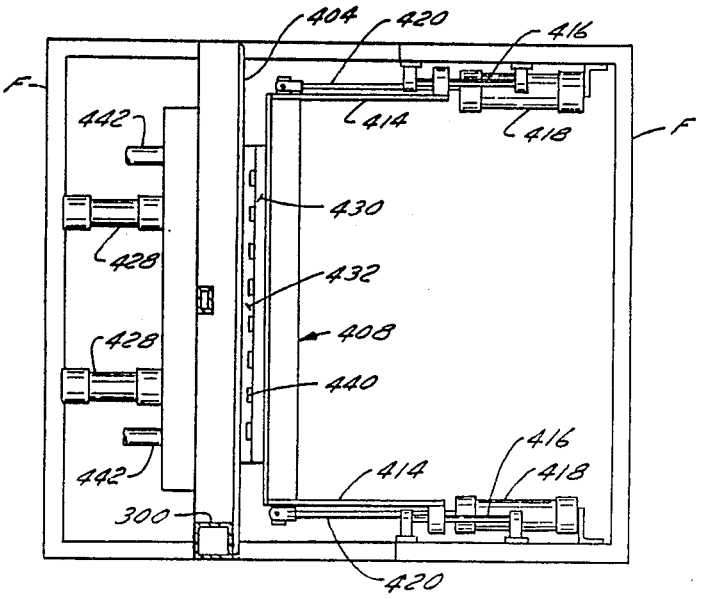
FIG. 17 is a top plan view of the device of FIG. 16.
Figure 18:
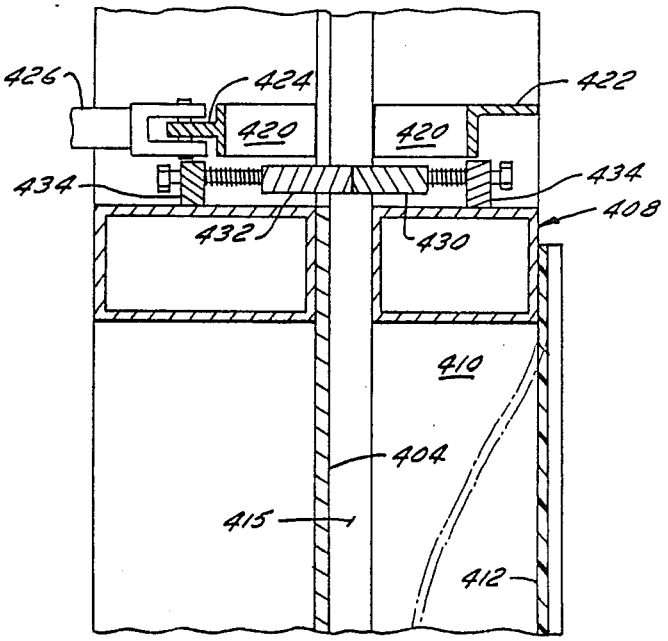
FIG. 18 is a cross sectional detailed view the vacuum device.
Figure 19:
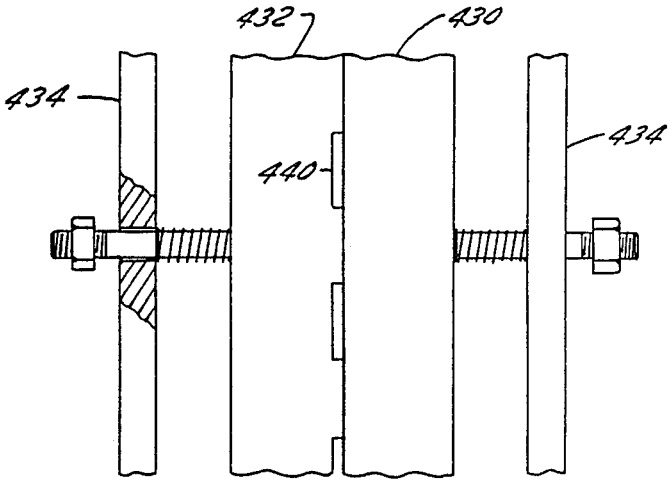
FIG. 19 is a cross sectional view of the vacuum device showing the clamping means.

Referring to the vacuum packaging system of the present invention, reference will now be made to FIGS. 5, 16 and 17 illustrating the apparatus. Again, all frame members are generally referred to by reference letter F.

Referring now to FIGS. 5 and 16 to 19, the vacuum packaging system of the present invention is illustrated and to this end, reference letter F generally designates frame members. In FIG. 16, the frame member 300 (see FIG. 5) is mounted on a vertical frame member; as will be seen from FIG. 16, the transport system delivers a suspended garment to the vacuum packaging station on guide rods 302. At this point, when the transport system is at the vacuum packaging station, the hanger 64 is transferred to a further hook 402 for positioning the garment at the vacuum packaging station. Thereafter, the transport system returns to its initial or first station at the wrapping device.

The vacuum packaging station includes a non-flexible or rigid plate 404 fixedly secured to the frame members F which forms one wall of a vacuum chamber. The wall 404 is non-movable and terminates, at the upper position, in a chamber 406 as described in greater detail hereinafter. Operating in conjunction with the rigid wall 404 is a further wall of flexible material which is mounted within a frame or housing 408, and which comprises side walls 410 defining an enclosure and extending to the top of the housing 406. The enclosure 408 includes a flexible layer of air impermeable material 412 essentially forming a flexible diaphragm therein and which is fixedly secured around its edges to the sides of the chamber 408. Air communication is provided between the flexible layer 412 and the back wall of the chamber 408; in an alternate embodiment of the present invention, there need not be provided a rear or side walls and instead a frame may be employed merely mounting the flexible sheet 412.

The chamber 408 is provided with a sealing gasket 415 whereby the gasket is adapted to form a vacuum chamber, in conjunction with the flexible wall 412, and the rigid wall 404, when the two walls are brought into operative relationship with each other. To this end, the wall assembly 408 is movably mounted on the frame members F of of the device for reciprocating movement into and out of operative engagement with the wall 404; flanges 414 are slidably journalled on guide rods 416 by means of appropriate bushings and a piston assembly 418 is provided with a piston rod 420 rigidly secured to the device 408. Actuation of the piston assembly 418 will bring the flexible wall into and out of engagement with the rigid wall 404.

Located within the vacuum chamber are a pair of cooperating sealing heads indicated generally by reference numerals 420 and 422, one associated with the wall 404 and the other with the movable wall assembly 408. Both are secured to the wall assemblies by means of appropriate mounting brackets 422; however, in the case of one of the sealing heads 420, the latter is mounted by means of a bracket 424 to a piston rod 426 of a piston assembly 428 adapted to bring that sealing head into and out of engagement with the opposed sealing head 420.

Operating in conjunction with the vacuum chamber are a pair of spring loaded clamping members 430 and 432 journalled by means of brackets 434 to a frame member of the vacuum assembly. These clamping members 430 and 432 are adapted to position the package to be scaled. One or both of these clamping members are provided with spaced-apart passages 440 (FIGS. 19 and 17) to permit air to be drawn from the chamber formed by the cooperating wall surfaces in which the package is located. A vacuum source (not shown) is operatively associated with a conduit 442 leading to the chamber 406, and creating a partial vacuum in the enclosure formed between the cooperating walls 404 and 412. In accordance with this invention, the above-described arrangement provides a vacuum packaging system in which the flexible wall is initially drawn against the central portion or area of the garment to be vacuum wrapped upon creation of a vacuum in the chamber defined as outlined above. Thus, inward movement of the flexible wall 412 initially contacts the central portion of the wrapped garment and thereafter, the vacuum causes the flexible wall 412 to subsequently contact the package in a direction moving towards the edges of the package which will thus prevent air pockets from being trapped in the package. As explained previously, this feature provides many desirable attributes to the vacuum packaging operation.

During the sealing operation, which takes place following the vacuum operation, the previously mentioned heat-sealable ligament 66 is thus sealed and forms a portion of the seal about the package. Thus, the ligament becomes a portion of the package and permits an airtight enclosure to be formed.

Figure 9:
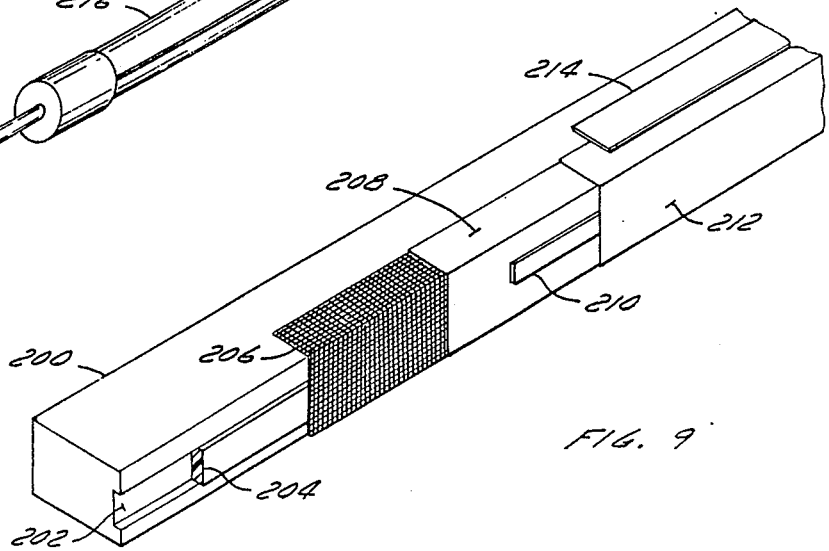
FIG. 9 is a detailed view of a sealing head used in the apparatus of the present invention.

The construction of the sealing heads 420 are similar to those described with reference to FIG. 9; however, it will be appreciated that other components may be employed.

Figure 15A:
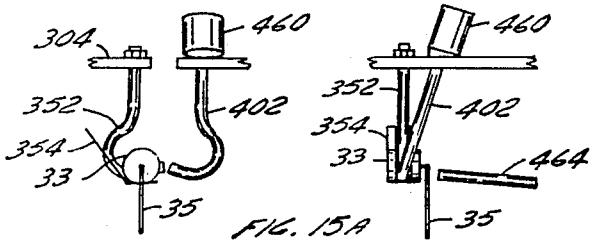
FIGS. 15A to 15C are side and front elevational views showing the sequence of operation and transferral of the wrapped article from one station to another.
Figure 15B:
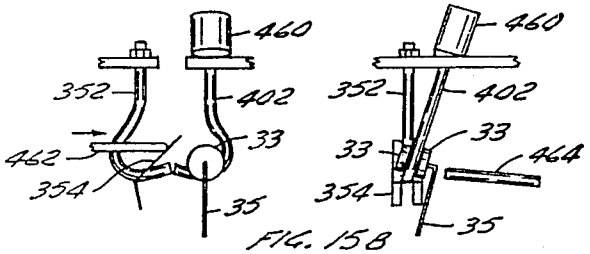
Figure 15C:
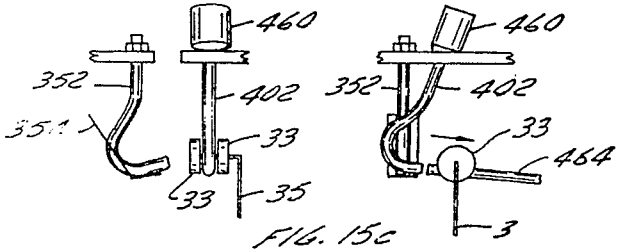

Referring now to FIGS. 15A to 15C, the transfer sequence for transferring the resulting sealed vacuum packaged garment described above, is illustrated. To this end, the carrying hook 352 associated with the transport device, which in turn carries the spare spaced-apart rollers 33 with a depending hook 35 mounting the hanger 64, operates as follows: the hook 402 associated with the vacuum packaging unit, which is rotatably driven by a motor 460, is positioned in alignment with the hook 352 at the point where the transport system arrives at the vacuum packaging unit upon reciprocation of the former. A pair of movable fingers 354 (FIGS. 12 and 13), mounted on a pivot point 356, are free to rotate about a horizontal axis so that the fingers 354, upon actuation, are adapted to engage a respective one of the pulleys 33 to advance the pulleys 33 onto the hook 402. Actuation of the fingers is carried out by a suitable piston assembly (not shown) mounting a piston rod 462, or by any other suitable means. As shown in FIG. 6, 15B, the finger 462 abuts the fingers 354 to pivot the same and push the wheels with its attendant hooks onto the hook 402.

As illustrated in FIGS. 15A through 15C, the hook 402 is mounted at a slight angle from the vertical and is capable of pivoting about its slanted vertical axis 90 degrees by means of the motor 460. Operating in conjunction with the vacuum station is a take-off rod 464 adapted to receive the wrapped vacuum packaged goods following completion of the vacuum packaging and to this end, once the operation has been completed, the motor 460 is actuated to rotate the hook 402 90 degrees to place the rollers 33 in a position to engage the rod 464. Thus, upon rotation, and as shown in FIG. 15C, the terminal portion of the hook no longer functions to retain the wheels 33 and they are free to slide off onto the rod 464. From there, and as illustrated in FIG. 1, the rod 464 delivers the wrapped goods to a storage area for subsequent packaging or delivery as required. The storage area, as indicated generally by reference numeral 480, may comprise a plurality of rods 482 associated with the rod 464.

Figure 20:
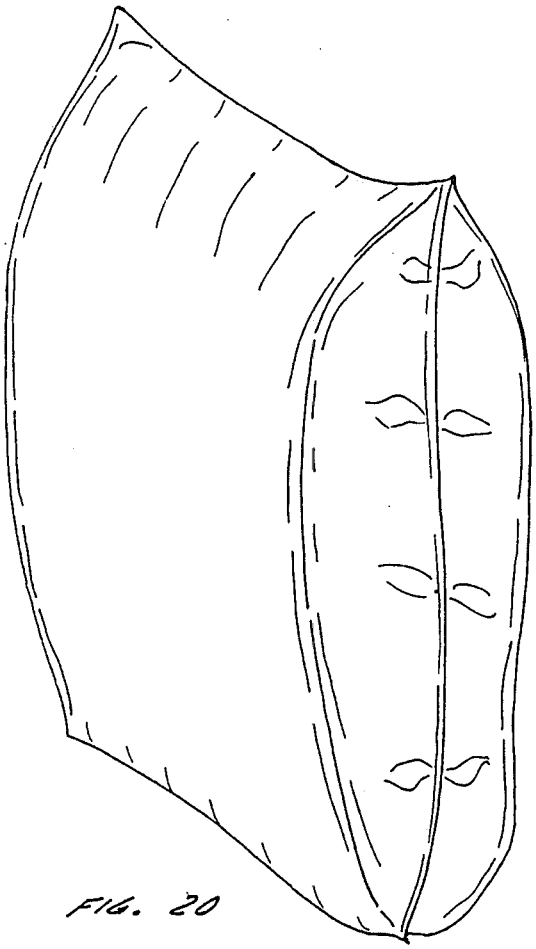
FIG. 20 illustrates an article prior to being wrapped and vacuum packed according to the system of the present invention.
Figure 21:
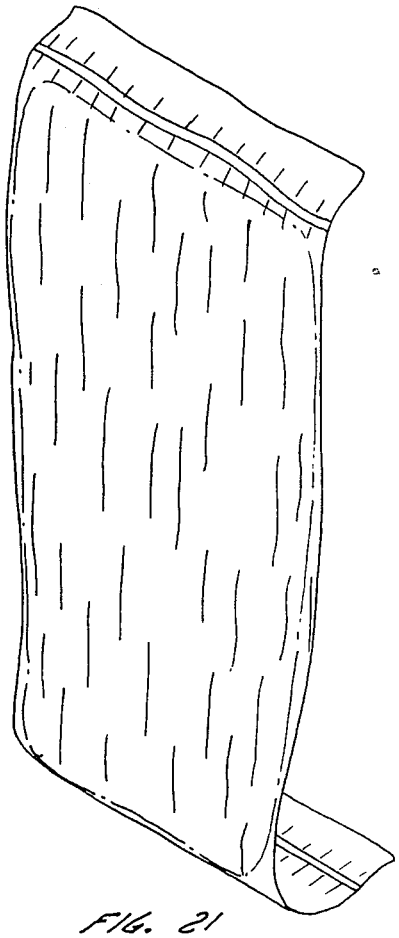
FIG. 21 illustrates the same article after wrapping and vacuum packaging with the system of the present invention.

Referring now to FIGS. 20 and 21, there is illustrated a cushion which may be wrapped and vacuum packaged according to the present invention. The cushion of FIG. 20 is a typical seat cushion having a covering enveloping a compressible foam core and which may typically have a dimension of e.g. 0.5–1 meter in width and length and a height of e.g. 0.25–0.3 meters. FIG. 21 illustrates the same product after processing according to the present invention and the width and length of the compressed product are substantially similar to that of the unpackaged product but the height has been compressed to approximately one fifth of the size of the product of FIG. 20.

All of the components of the system described herein may be operated in time-related sequence with conventional control means well known to those skilled in the art. Thus, the function of each component may be operated in a time-related sequence to other components with the whole assembly being controlled by an appropriate control system. As indicated, such systems are well known to those skilled in the art and no detailed explanation is required.

Figure 22:
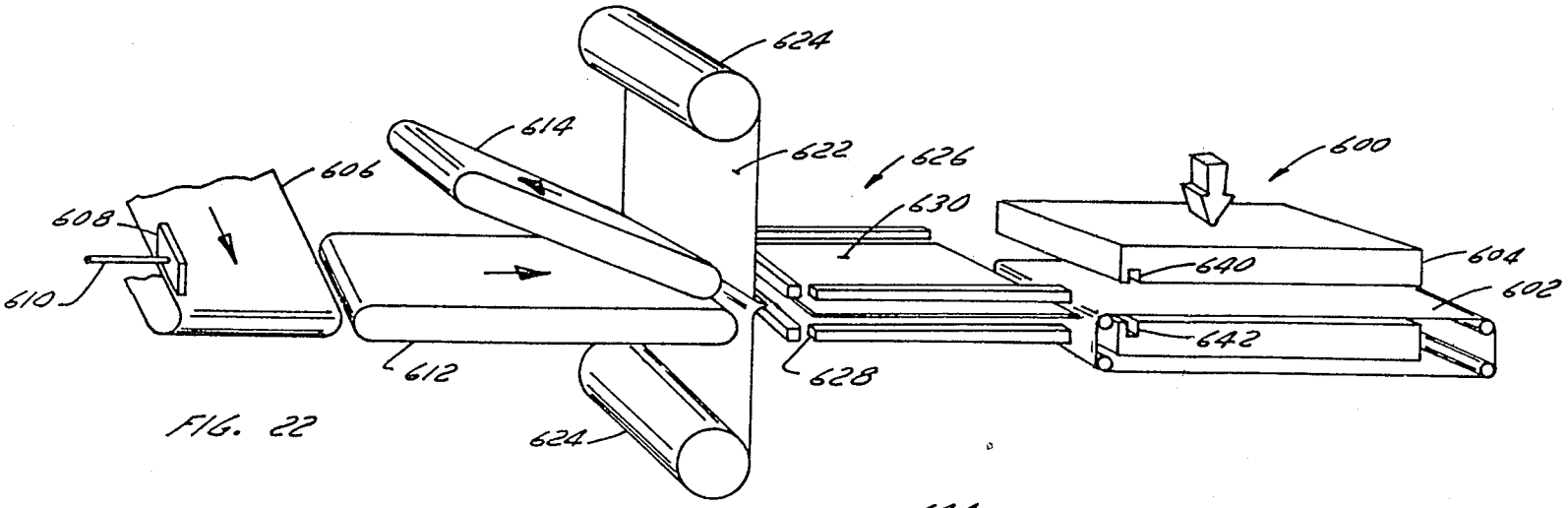
FIG. 22 illustrates a still further system packaging material.
Figure 23:
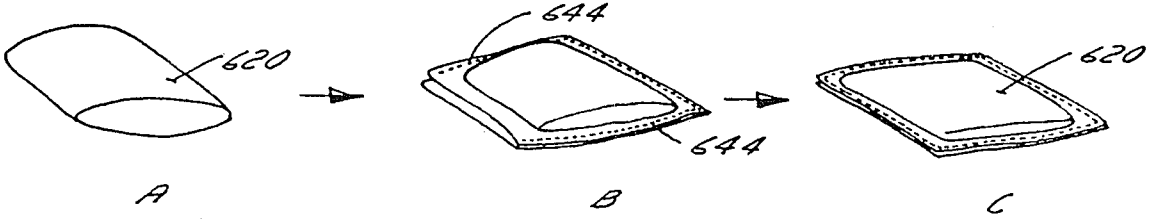
FIGS. 23A–23C illustrate a commodity in the various stages of wrapping using the system of FIG. 22.

Referring to the system of FIGS. 22 and 23, a vacuum packaging apparatus is indicated generally by reference numeral 600 which has substantially the identical structure to that described previously and as such, includes a rigid will and a flexible wall which together with a sealing gasket or the like, is adapted to form a vacuum chamber in which a commodity to be vacuum packaged is processed. In this case, however, the flexible wall 602 may be in the form of an endless belt which is adapted to be rotated so that the solid wall 604, adapted to be brought into and out of engagement with the flexible wall 602, can be raised and the flexible wall rotated to discharge a commodity.

As will be noted from FIG. 22, the system herein employs a generally horizontal system as opposed to the vertical system previously described and the horizontal system may be appropriate employed for packaging commodities such as cushions or the like which do not have to be suspended (as in the case of garments).

A commodity to be packaged is delivered by means of a conveyor 606 (driven by suitable means not shown) and is transferred to the initial processing station by means of a movable plate 608 connected to a piston rod 610 driven by a suitable piston (not shown). The plate 608 is adapted to deliver an article from the conveyor 606 onto a further conveyor 612 rotating in an advancing direction. A cooperating endless belt conveyor 614 is mounted at an angle to the conveyor 612 to form a converging mouth or path to form a positive drive system for feeding the commodity 620 into the subsequent processing stations. To this end, film material or other like packaging material 622, taken from one or more sources 624 is located in the path of the movement of the commodity 620 and as the commodity is advanced by the rotating conveyors 612 and 614, the leading edge of the commodity will engage the wrapping material and draw the same around the commodity 620. The commodity is advanced to the processing station indicated by reference numeral 626 in which the side edges of the commodity are sealed. The assembly 626 may comprise any suitable means for this purpose and as such, one or more of the surfaces 628 and 630 may be movable with suitable sealing means located on the sides to seal the wrapping material. Thereafter, the commodity may be advanced by suitable means from the processing station 626 to the vacuum packaging unit which includes sealing bars 640 and 642 to seal the top of the package after the latter has been 25 evacuated.

As shown in FIG. 23, the commodity 620 as it enters the spaced apart conveyors 612 and 614 is slightly compressed as it is delivered to the processing system 626 with side seals 644 being made in the wrapping material and thereafter, the final compression and vacuum sealing to produce the product 620′ takes place in the vacuum packaging unit 600.

The following example will serve to illustrate the various aspects described previously with respect to the apparatus of FIGS. 1–21.

For this example, the apparatus previously described was employed in which the conditioning system contained two zones—i.e., the treatment zone and the stabilization zone. Each of the two zones is provided with a plurality of air ducts located at the top of the tunnel and with a corresponding number of circulation fans placed on the bottom of the tunnel with air inlets being provided.

Conditioning air was provided for by passing a mixture of ambient air from outside the tunnel and air in the tunnel through dehumidifying and cooling machines to provide conditioning air. The conditioning air provided for the stages of the treatment tunnel range from 30°–20° C. and 30–15% relative humidity; and in the different stages of the stabilization zone, 20° C.–15° C. and 12%–5% relative humidity. Suitable control means for introducing the conditioned air were provided to obtain a balance air flow in each zone and preferably in each stage of each zone.

Samples of men's suits, made of 100% wool, were introduced into the conditioning system described previously at the inlet port on the conveying system. The ambient atmospheric conditions at this point were approximately 30° C. 25 and 60% relative humidity. The system was set for an operational time limit, from entering the treatment tunnel to the discharge, of approximately 60 minutes. The initial treatment stages were set in operation with conditioned air being introduced at a rate of 400 liters per second. In the stabilization zone, conditioned air was being introduced at a volume of approximately 200 liters per second with air temperatures in the initial portion of the treatment zone being approximately 30° C. and in the later stage of the treatment zone approximately 20°–15° C. The air temperature in the stabilization zone was maintained at a constant 15–20° C.

The garments being treated were subjected to treatment using the conditioned air to dehumidify and condition the garments for a period of approximately 30 minutes. It was found, after running the system, that as a result of the conditioned air being introduced, and the mixture of conditioned air and ambient air, a mixture was obtained in which the relative humidity varied from approximately 30% at the initial stage of the treatment zone to approximately 15% at the end or latter stage of the treatment zone. In the stabilization zone, the relative humidity was maintained at a constant 10%.

In the above system employed, the length of the treatment zone was approximately 10 meters with the height of the whole system being approximately 2 meters and having a width of approximately 80 centimeters. The stabilization zone had a length of approximately 10 meters and air was removed at a constant volume of approximately 480 liters per second (with a total of 1200 cubic meters per hour being removed from both zones).

Upon exiting from the stabilization zone, the garments were tested and found to contain a moisture regain corresponding to equilibrium in air, of 10–12% relative humidity, and 20° C. These garments were subsequently wrapped using the wrapping apparatus and vacuum packaged, using the vacuum packaging apparatus described above. Packaging reduced the volume of the garments, depending on the type of garment, to between $\frac{1}{3}$–$\frac{1}{2}$ of their original volume.

The garments were stored for approximately 1 week and thereafter, the vacuum packaging removed. Such garments were found to be substantially free from wrinkles and in a totally acceptable commercial condition.

If desired, following removal of the vacuum packaging from the garment, the product may be reconditioned by exposing the same to relative humidities of 50% or greater and temperature conditions of 20°–45° C. In effect, this reconditioning step speeds the recovery of the garment from its compressed state to its normal original condition without having to wait for longer periods of time.

It will be understood that various modifications can be made to the above-described embodiments without departing from the spirit and scope of the invention.

We claim:

1. An apparatus for wrapping and vacuum packaging a substantially compressible commodity comprising means for supplying a substantially compressible commodity to a wrapping station;

means for supplying flexible, air impermeable tubular wrapping material having opposed wall sections to said wrapping station from a continuous length source;

means for enveloping said compressible commodity with said wrapping material at said wrapping station such that an unsealed open mouth of said wrapping material extends beyond said compressible commodity;

means to sever said wrapping material enveloping said compressible commodity from said continuous length source and seal the bottom portion of said severed wrapping material to form a commodity-containing bag having a closed bottom and an open mouth;

a vacuum packaging station including vacuum packaging means comprising a flexible air impermeable membrane and a substantially co-extensive opposed surface defining therebetween a commodity receiving area for receiving a commodity-containing bag, said membrane comprising a single, flexible, inwardly deformable sheet material positioned between and supported along its entire periphery by a membrane frame in a manner so as to provide an airtight joint between said membrane and said frame, one surface of said membrane facing said co-extensive opposed surface and an opposing surface of said membrane being in communication with ambient air;

means for bringing said substantially co-extensive opposed surface and said membrane-supporting frame into sealing engagement with each other to form a vacuum chamber laterally defined by said opposed surface and said membrane and adapted to contain said open-mouthed commodity-containing bag and enable displacement of air from the bag to be effected, said periphery of said membrane being spaced from said opposed surface upon said frame being brought into sealing engagement with said opposed surface a distance sufficient to permit said membrane to deform inwardly toward said opposed surface upon evacuation of said chamber;

means for advancing said commodity-containing bag to a position between said co-extensive opposed surface and said membrane;

vacuum means for evacuating said chamber to cause inward deformation of said flexible membrane toward said opposed surface to cause displacement of air from said open-mouthed commodity-containing bag, said deformation commencing in the central portion of said membrane and subsequently progressing outwardly therefrom so as to reduce entrapment of air in the commodity-containing bag; and means for sealing said open mouth portion of said commodity-containing bag subsequent to the displacement of air from said bag.

2. An apparatus as claimed in claim 1 wherein said opposed surface is a rigid surface.

3. An apparatus as claimed in claim 2 wherein the wrapping station comprises a wrapping assembly having said means for supplying said wrapping material, means for engaging and maintaining said opposed wall sections of the leading portion of said wrapping material in a spaced-apart manner to form a commodity-receiving space, means for vertically advancing said wrapping material with said walls in a spaced-apart manner from a first vertical position to a second terminal vertical position in a predetermined path, means for vertically positioning a commodity to be enveloped by said wrapping material in said predetermined path whereby when said advancing means vertically advances said wrapping material from said first position to said second terminal position, said commodity is enveloped by said material as said material advances between said vertical positions.

4. An apparatus as claimed in claim 2 wherein one of said flexible membrane or said opposed surface is mounted in a movable housing, and the other of said flexible membrane or said opposed surface is mounted in a fixed relationship relative to said movable housing.

5. An apparatus as claimed in claim 4 wherein said means for bringing said supporting means and said opposed surface into engagement with each other comprises means for pivoting said housing about a fixed point.

6. An apparatus as claimed in claim 1, said apparatus further including a conditioning apparatus suitable for conditioning a compressible fibrous material to render the same substantially free from wrinkles prior to being wrapped and vacuum packaged, said conditioning apparatus comprising an elongated chamber having a first conditioning section;

said conditioning section comprising a plurality of communicating compartments, each compartment of said conditioning section having at least one conditioning air inlet, means for supplying a source of dehumidified conditioning air for conditioning said fibrous material at a low relative humidity to said conditioning air inlet, and means to remove spent conditioning air from said conditioning section, said conditioning section compartments extending in the direction of travel of the fibrous material through said conditioning section;

a stabilization section in said chamber in communication with said conditioning section, said stabilization section being downstream of said conditioning section in the direction of movement of a fibrous material through said conditioning apparatus, a plurality of stabilizing air inlets in said stabilization section spaced from each other, means for supplying stabilizing air to said plurality of stabilizing air inlets, means to remove spent stabilizing air from said stabilization section;

conveying means for conveying said fibrous material sequentially through said conditioning section and said stabilization section and said means for supplying stabilizing air comprising means for providing air at a relative humidity of less than about 15% and at a temperature less than about 30° C.

7. An apparatus as claimed in claim 6 further comprising a retention chamber in communication with said stabilization section wherein conditioned commodities may be retained subsequent to conveyance through said stabilization section.

8. An apparatus as claimed in claim 6 wherein said means for supplying a source of conditioning air provides a mixture of ambient air and conditioned air.

* * * * *